US008430238B2

(12) United States Patent
Moore

(10) Patent No.: US 8,430,238 B2
(45) Date of Patent: Apr. 30, 2013

(54) HANGING, TELESCOPING GARMENT ORGANIZER

(76) Inventor: Steve Moore, Greenwood Village, CO (US)

( * ) Notice: Subject to any disclaimer, the term of this patent is extended or adjusted under 35 U.S.C. 154(b) by 462 days.

(21) Appl. No.: 12/798,853

(22) Filed: Apr. 13, 2010

(65) Prior Publication Data

US 2011/0247948 A1 Oct. 13, 2011

(51) Int. Cl.
*B65D 85/18* (2006.01)

(52) U.S. Cl.
USPC ..... 206/279; 206/278; 220/8; 221/304; 221/309

(58) Field of Classification Search ..... 229/125.12, 229/125.125, 101; 220/8, 345.2; 221/304, 221/309, 281; 206/278, 279
See application file for complete search history.

(56) References Cited

U.S. PATENT DOCUMENTS

| | | | | | |
|---|---|---|---|---|---|
| 1,184,525 | A | * | 5/1916 | Hammond | 190/104 |
| 2,235,473 | A | * | 3/1941 | Blinstrub | 206/124 |
| 2,683,953 | A | * | 7/1954 | Hopkins | 43/131 |
| 3,175,853 | A | * | 3/1965 | Gilbertson | 292/86 |
| 3,451,612 | A | * | 6/1969 | Sinoto | 229/103 |
| 3,514,008 | A | * | 5/1970 | Dorn | 220/8 |
| 3,599,830 | A | * | 8/1971 | Gilchrist et al. | 221/188 |
| 3,972,094 | A | | 8/1976 | Fuller | |
| 4,261,461 | A | * | 4/1981 | Kizlauskas | 206/765 |
| 5,147,119 | A | | 9/1992 | Harris | |
| 5,472,052 | A | * | 12/1995 | Head | 166/298 |
| 5,740,944 | A | | 4/1998 | Crawford | |
| 6,126,021 | A | | 10/2000 | Wilhite | |
| 6,588,626 | B2 | * | 7/2003 | Sauer et al. | 221/49 |
| D560,383 | S | | 1/2008 | Woods | |
| 7,484,620 | B2 | * | 2/2009 | Miller et al. | 206/379 |
| 2006/0000681 | A1 | * | 1/2006 | Barker et al. | 190/18 A |

* cited by examiner

*Primary Examiner* — Tri Mai
(74) *Attorney, Agent, or Firm* — R. Ruschena Patent Agent, LLC

(57) ABSTRACT

This invention is related to a hanging, telescoping garment organizer for storing, displaying and dispensing rolled pair of socks or other small garments, comprising an upper and a lower container of elongated, tubular shape. The lower container can be telescoping inside the upper container to reduce the organizer's space when not in use. The lower container is held attached to the upper container by a plurality of snap hooks that snap locked with the corresponding locking edges at the bottom of the upper container. The front sides of both the upper and lower containers have vertical openings sufficiently wide to allow easy manual insertion and retrieval of rolled pairs of socks or other small garments. The upper container, which is holding the lower container, can be hanged to an hanging bar using the incorporated, unobtrusive hanging system, that allow the top part of the upper container to slide over the hanging bar until the hanging bar is held in place by a round-shaped hanging slot preventing involuntary sliding backward of the upper container. The organizer provides a plurality of clips that can be mounted on the lateral outside walls of the upper container to suspend loose socks to facilitate their matching.

6 Claims, 3 Drawing Sheets

HANGING, TELESCOPING GARMENT ORGANIZER

BACKGROUND OF THE INVENTION

1. Field of the Invention

This invention relates to an apparatus for storing, organizing, displaying and dispensing pairs of socks or other small garments and more particularly to a hanging, telescoping garment organizer featuring an incorporated hanging system.

Typically, socks are scattered in a dresser drawer in the bedroom while clothing is usually hung in the closet. It is then often difficult to mach the socks to the clothing to wear, when the socks are kept in a different area. The clothes need then to be brought from the closet to the bedroom, or vice versa, to perform the clothes/socks match operation.

It is with respect to these considerations and others that the present invention has been conceived, by providing the capability of storing and organizing socks and other small garments in the closet area, where commonly most of the clothes are hanged. This novel garment organizer comprises an imbedded hooking system to allow the organizer to be hanged to the closet's hanging bar or to be hung on a wall.

This invention allows keeping socks and other small garments organized, yet visible, while neatly rolled one inside the other and stored inside the organizer, which also separately store in evidence, single "stray" socks, until their lost matches are found. To accomplish this, a plurality of optional sock clips can be mounted on the outside walls of the organizer to temporarily clip in view unmatched socks.

The organizer comprises an upper, tubular container and a lower, tubular container which are telescoping one inside the other to decrease the volume of the organizer facilitating shipping, packaging and minimizing the storage space when the organizer is not in use. The lower container can in fact be totally contained inside the upper container.

Rolled pairs of socks or other small garments can be inserted, displayed and retrieved through the front side vertical openings of both the upper and lower containers.

2. Brief Description of the Prior Art

Numerous containers are available to store and organize a variety of items, but organizers and similar devices, specifically designed to store and organize socks are not abundant as socks are considered, generally, a low-attention garment.

U.S. Pat. No. 6,126,021 defines an Article Storage System capable of being suspended, having two vertical rows of compartments with side access openings to store a variety of items. The apparatus is collapsible to ease transportation and storage when not hanging, However, this apparatus is completely different in all aspects from the present invention.

U.S. Pat. No. 3,972,094 "Device for Securing and Storing Paired Socks" describes a compartmentalized box to store pairs of socks using clips. Although this device neatly separates pair of socks form one another, after being matched with their respected partners socks pairs do not actually need to separate from other pairs, therefore, the compartmentalized containers are superfluous. As in the present invention, one sufficiently large container, consisting of an upper and lower container, is more effective for storage and selection of paired, rolled socks.

The sock storage and dispenser of U.S. Pat. No. 5,740,944 depicts a multiple parallel slots to provide capacity storage. In the present invention, the capacity storage is provided by one upper container whose volume is doubled when the lower container is telescopically extended out of the upper container. This represents the significant novelty of the present invention.

U.S. Pat. No. 5,147,119 shows a vertical container for storing pairs of socks having its capacity limited by its size. Additionally, the vertical container is not designed to be hanged. The biggest drawback of this device is that the only retrievable pair of sock is the one on the bottom of the stack, which it could not be the one desired.

Chinese patent CN 201175229 Y shows an ineffective, hanging sock-shape container with multiple, yet limited, number of divisions to store few small garments.

Canadian patent application 2 654 075 A1 shows a hanging, collapsible garment organizer comprising multiple, independent containers each with an individual access panel that can be opened to insert the garment. Unless the little doors are made of transparent material, the garments stored will not be visible. This design is completely different from the present invention.

SUMMARY OF THE INVENTION

In accordance with the present invention, the above-described limitations and problems for effectively storing and organizing pairs of socks or other small garments are resolved by the present invention.

In the present invention, the storage capacity is provided by one tubular upper container whose capacity is basically doubled when the lower container of equivalent size of the upper container is telescopically extended out of the upper container.

The upper and lower containers of the present invention have usually a square section, but they could also have a variety of sections, including a tube-like, circular section. Their section size is specifically dimensioned to allow a rolled pair of socks or other small garments to be held inside either the upper or lower container by the friction of the rolled socks against the three enclosing walls. Additionally, rolled socks are prevented from falling out through the front wall openings by the added left and right socks retaining hedges.

To allow an easy insertion and retrieval of the rolled socks or other small garments, the front walls of both the upper and lower container have vertical openings, for easy insertion, extraction and partial view of the rolled pairs of socks or other small garments. The two sides retaining edges are carefully dimensioned to prevent the rolled pairs of socks from falling out of the upper or lower container.

The upper and lower containers are preferably made of clear plastic or similar material, but not necessarily made of transparent material, as the stored socks or other garments are partially visible through the front wall openings from which they are inserted inside the organizer.

Depending on the thickness of their fabric and size, the rolled pair of socks or other garments may or may not be descending by gravity to the bottom of the lower container, but they may be moved up or down manually, if needed, throughout the front walls openings of both the upper and lower container.

Because of the elasticity and compressibility of the rolled pair of socks or other small garments, some will stay put wherever they have been inserted, as each pair of socks can be inserted at any point of the front opening of both the upper or lower container, wherever there is space available inside the organizer.

The imbedded hanging system of the upper container consists of a horizontal slot opening on the back side of the upper container to allow the organizer to be positioned over the closet's hanging bar and remain securely in place. Alternatively, the organizer can be attached to a wall's protruding nail, hook or screw, using a hanging hole and related retaining lip present on the upper container's back side wall.

The apparatus is relatively inexpensive, easy to use and resolves the common problem of socks' storage in the most satisfactory manner.

These and various other features, as well as advantages, which characterize the present invention, will be apparent from a reading of the following detailed description and a review of the associated drawings.

BRIEF DESCRIPTION OF THE DRAWINGS

The accompanying drawings, which are incorporated in and constitute a part of the specification, illustrate an embodiment of the invention, and, together with the description, serve to explain the principles of the invention, wherein:

FIG. 4 also shows the clip openings on the side wall 4 that allows the insertion of the sock's clip 13 that can be used to hang to the side wall(s) unmatched, loose socks 14;

DETAILED DESCRIPTION OF THE PREFERRED EMBODIMENT

A preferred embodiment of the present invention will be described hereinafter with reference to the accompanying drawings.

Figure 1:
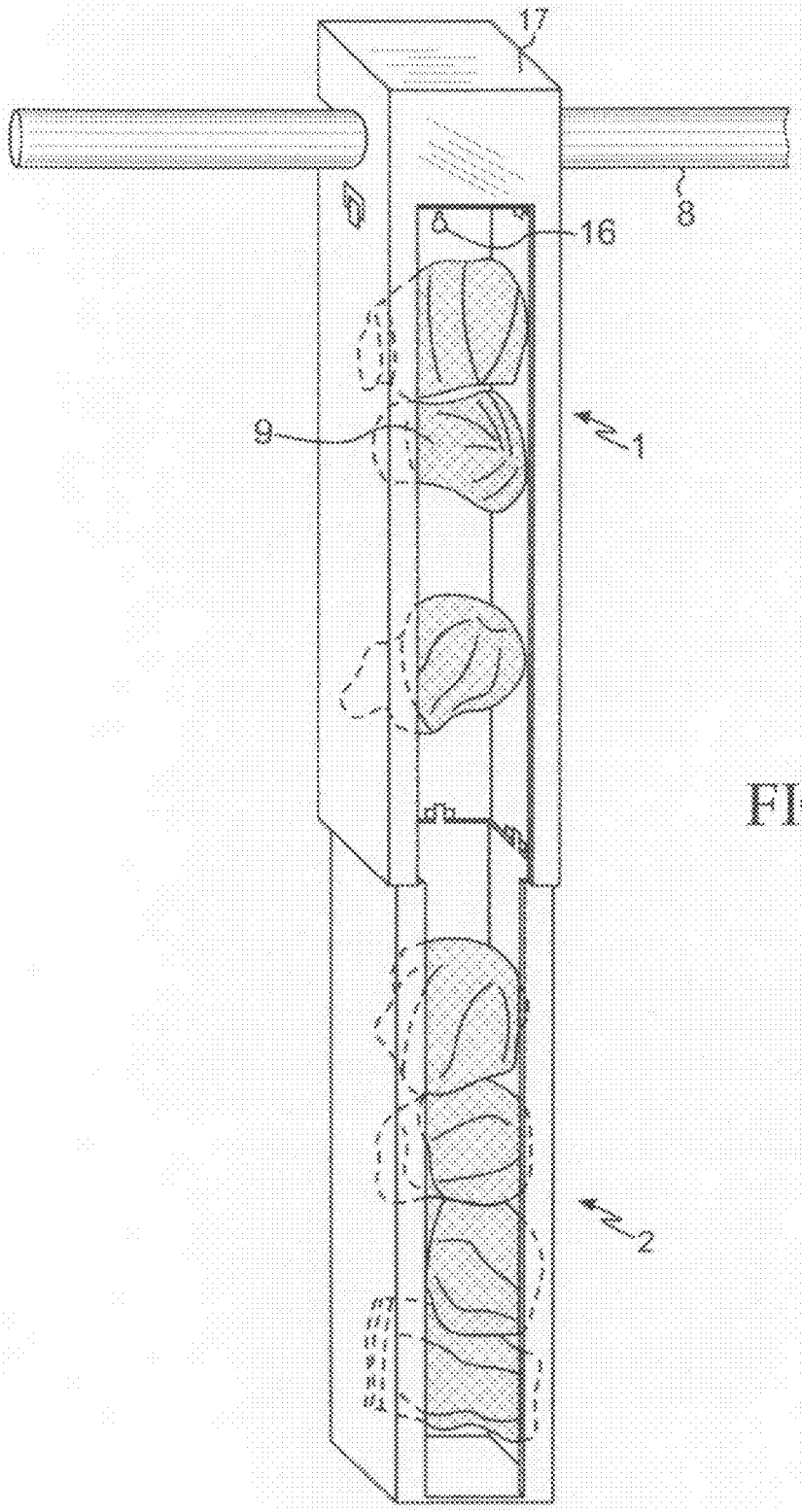
FIG. 1 illustrates the hanging, telescoping garment organizer in operation, hanging usually from a closet's hanging bar. Visible is the lower container fully extended out of the upper container, doubling the overall storage capacity.
Figure 2:
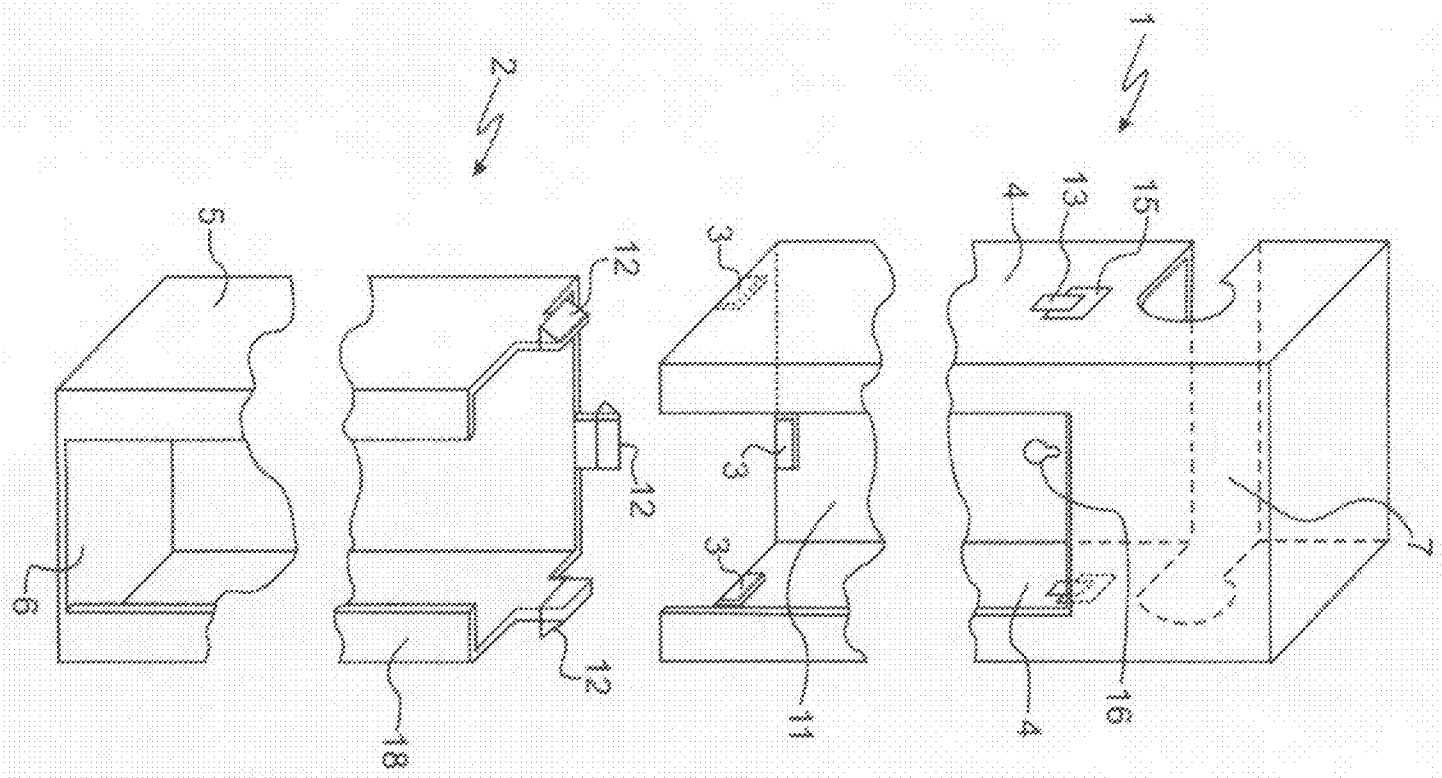
FIG. 2 illustrates the upper container 1 and the lower container 2 which is inserted, at the time of assembly, from the bottom of the upper container by sliding it inside the upper container 1. The lower container is prevented from sliding out from the upper container and becoming disconnected, by way of a plurality of locking edges 3 that are catching the correspondent plurality of snap hooks 12.

As illustrated on FIGS. 1 and 2, the organizer comprises two elongated, tube-like containers, an upper container 1 and a lower container 2 that can a have a variety of sections, the upper container having a top side surface 17 and no bottom surface, while the lower container 2 has a bottom surface 6 and not a top surface. The lower container 2 is capable of sliding completely inside the upper container 1 to reduce the space of the organizer when it is not in use. For this purpose, the external sizes of the lower container 2 are slightly smaller than the upper container 1, to allow the lower container 2 to slide snug inside the upper container 1. The friction between the walls of the two containers will be sufficient to avoid the undesired sliding of the lower container 2 out of the upper container 1, when the upper container 1 is hanged to a hanging bar, because of its own weight and the weight of socks or other garments stored inside it. This is to allow the use of the organizer by keeping the lower container 2 totally or partially inside the upper container 1 whenever a smaller volume of stored garments is needed.

The lower container 2 is securely connected to the upper container 1 so that when the entire unit is hanged, or the lower container 2 is manually extracted from the upper container 1, the lower container 2 is prevented to be separated from the upper container 1, by a plurality of snap hooks 12.

FIG. 1 illustrates the hanging, telescoping garment organizer in operation, hanging from the closet's hanging bar 8. The figure shows the upper container 1 that holds securely the lower container 2 by way of the multiple snap hooks 12 that are attached to the corresponding locking edges 3 on the upper container.

As illustrated on FIG. 2, the upper container 1 has a plurality of locking edges 3, attached or incorporated to the bottom of the inside side walls 4 and the back side wall 11 to produce a thicker edge around the bottom edge of those three walls.

The lower container has a plurality of snap hooks 12 that are attached or incorporated to the inside top edges of its three walls 5. This plurality of snap hooks 12 snap locked with the corresponding locking edges 3 of the upper container 1, whenever the lower container 2 is inserted, usually by the manufacturer, inside the bottom part of the upper container 1. This plurality of snap hooks 12 prevent the lower container 2 to become disconnected from the upper container 1 whenever the lower container 2 is sliding out the upper container 1.

Figure 3:
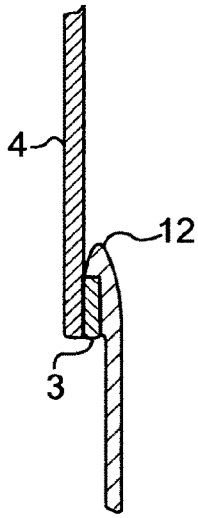
FIG. 3 illustrates a detail of a snap hook 12 and corresponding locking edge 3 and how the plurality of snap hooks 12 are incorporated to the top of each side wall 5 of the lower container 2.

The detail of FIG. 3 illustrates how a snap hook 12 attached to each side wall 5 of the lower container 2 is catching a corresponding locking edge 3 attached or incorporated to the inside of both side walls 4 and to the upper container back side wall 11.

As illustrated on FIG. 1, the vertical openings on the front wall of both the upper and lower containers 1 and 2 are designed to allow the stored rolled socks or other small garment 9 to be visible for easy matching with clothes, and retrieval. These front openings allow the easy insertion and extractions of the pairs of rolled socks or other small garment 9 at any vertical position of the two containers by slightly forcing them through the front vertical openings of each container. The front wall openings, of both the upper and lower containers, have on both sides a sock retaining edges 18 which prevent the inserted socks from falling out of the container because of their own gravity. This feature allows rolled pair of socks or other garment 9 to be inserted and retrieved randomly, within the already stored stack of rolled pair of socks, as they are held inside by the friction of three container's walls 4 and 5, including the back wall 11 and by the socks retaining edges 18 on the front of both the upper and lower containers.

Figure 4:
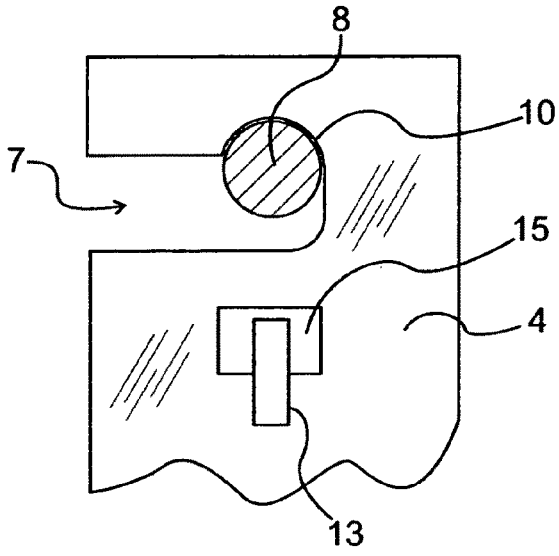
FIG. 4 is a side view of the upper container side wall 4 showing the hanging opening 7 that allows the insertion of the upper container 1 over the closet hanging bar 8.

As illustrated on FIGS. 1, 2 and 4, the telescoping garment organizer can be hung, usually to a closet's cloth bar, to be near the clothes to facilitate a selection of the most suitable pair of socks for the clothes to be worn. FIG. 4 is a detailed side view of the upper container side wall 4 showing the details of the hanging opening 7 that allows the insertion of the upper container 1 over the closet hanging bar 8. The upper container 1 can be freely positioned over the hanging bar 8 by allowing the hanging bar 8 to slide freely through the hanging opening 7 on back side wall 11 until the hanging bar 8 is situated under the hanging bar slot 10 which prevents involuntary sliding backward of the upper container 1. The hanging bar slot 10 has a diameter slightly bigger that the hanging bar's 8 diameter. This hanging system is completely internal and unobtrusive to facilitate the packaging and shipping of the organizer.

Alternatively, the organizer can also be attached to a wall by way of positioning it over a protruding nail, hook or screw, which can penetrate inside the hanging hole and under the related retaining lip 16, present on the upper container back side wall 11, as illustrated on FIGS. 1 and 2.

It is also possible to use the organizer not hanged, but standing on a flat surface on its lower container bottom side.

FIG. 4 also shows the clip opening 15 on the side wall 4 of the upper container 1 that allows the insertion of the sock's clip 13 that can be used to hang unmatched socks 14 to the side wall(s) 4.

As illustrated on FIG. 2, on the upper part of the side walls 4 of the upper container 1, there are multiple clip openings 15 to allow optional sock's clips 13 to be inserted. As also illustrated on FIG. 5, these sock's clips 13 are capable of suspending unmatched, loose socks 14 or other small garments. Each sock's clip 13 is usually made of plastic or light metal having a spring-like flexibility, shaped in such way that can be manually inserted over the lower edge of multiple small window-like clip openings 15 on the side walls 4 of the upper container 1 and remain in its place when a loose sock or other garment is inserted underneath, because its curved upper part is retained by the upper edge of the window-like clip opening 15. Each sock's clip 13 has sufficient spring action to hold a single, loose sock 14 or other small garment, squeezed between the sock's clip 13 and the external side wall 4 of the upper container 1.

Figure 5:
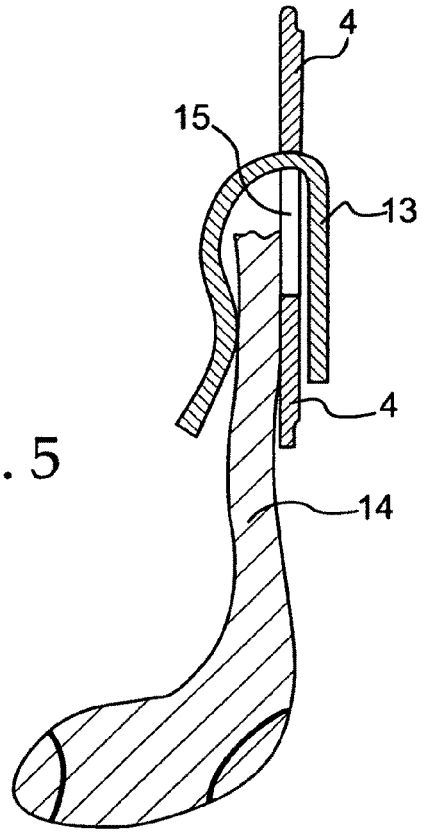
FIG. 5 illustrates a cross section of the side wall 4 of the upper container showing the opening 15 which allows the insertion of an optional sock's clip 13 to hold an unmatched, loose sock 14.

FIG. 5 illustrates in detail a cross section of the side wall 4 of the upper container 1 showing the clip opening 15 which allows the insertion of an optional sock's clip 13 to hold an unmatched, loose sock 14 attached to the external side wall 4. The spring action of the internal side of sock's clip 13 exerts a force toward the side wall 4 sufficient to win the gravity of the sock, holding the unmatched sock or other small garment suspended in view to facilitate its matching. The embodiment described above is provided by way of illustration only and should not be construed to limit the invention. Those skilled in the art will readily recognize various modifications and changes that may be made to the present invention without following the example embodiment and application illustrated and described herein, and without departing from the true spirit and scope of the present invention, which is set forth in the following claims.

What I claim is:

1. A hanging, telescoping garment organizer to store a plurality of pair of socks or other small garments, comprising:

a. an upper container to be hung to a hanging bar by way of an incorporated, hanging system; said upper container has an elongated, tube-like shape, having a top side surface and no bottom side surface; said upper container having a vertical opening on its front side sufficiently wide to allow easy, manual insertion and retrieval of rolled pairs of socks or other small garments; said upper container comprising a plurality of locking edges, incorporated to the bottom of the inside side walls and back side wall of said upper container to produce a thicker, protruding catching edges around the bottom edges of said three walls;

b. a lower container, attached securely to the bottom edge of said upper container when is manually telescoped out from the bottom of said upper container; said lower container, which has an elongated, tube-like shape, is capable of telescoping completely inside said upper container, to reduce the shipping space and to minimize the space of said organizer when not in use; said lower container comprises a bottom surface and no top surface, and a plurality of snap hooks that are incorporated to the inside top edges of the three side walls of the lower container, said plurality of snap hooks snap locked with said corresponding locking edges of the upper container, when said lower container is inserted inside the bottom part of the upper container; said plurality of snap hooks prevent said lower container to become disconnected from said upper container when manually pulled out of the upper container; said lower container has a vertical opening on its front side sufficiently wide to allow easy, manual insertion and retrieval of rolled pairs of socks or other small garments and said vertical opening is forming a unique front opening as a continuation of the vertical opening of said upper container;

c. sock's clips that can be inserted inside a plurality of clip openings present on one or both side walls of said upper container, said sock's clips are capable of suspending in view unmatched, loose socks or other small garments.

2. A hanging, telescoping garment organizer according to claim 1, wherein said hanging system incorporated in the upper container comprises an horizontal opening on the back side wall and on the side walls of the upper container to allow the sliding of said upper container over a hanging bar until the hanging bar is situated underneath the round-shaped hanging bar slot which has a diameter slightly bigger that the hanging bar's diameter, said hanging bar slot is holding said upper container in place over said hanging bar while preventing involuntary sliding forward of said upper container causing its possible fall to the ground.

3. A hanging, telescoping garment organizer according to claim 1, wherein said lower and upper containers, have a vertical front opening and two vertical socks retaining edges on their front sides, sufficiently wide to allow an easy manual insertion and retrieval of pairs of socks or other small garments, while said socks retaining edges on both sides of the vertical openings facilitate the inserted pair of socks or other garments to remain inside the upper and lower containers.

4. A hanging, telescoping garment organizer according to claim 1, wherein said upper and lower containers are made of materials selected from the group consisting of plastic, light metal and light wood.

5. A hanging, telescoping garment organizer according to claim 1, wherein said sock's clips are made of plastic or light metal having a spring-like flexibility, and are shaped in such way that can be manually inserted and stay positioned over the lower edge of small window-like openings made on the side walls of the upper container; each sock's clip having a sufficient spring action to hold a single sock or other small garment suspended, compressed between said sock's clip and said external side wall of the upper container.

6. A hanging, telescoping garment organizer according to claim 1, wherein said lower container is held by friction inside said upper container when said upper container is hanged to a hanging bar; said friction between the walls of both upper and lower containers is sufficient to prevent the lower container from sliding outside the upper container by the action of its own weight and the weight of the stored garments inside it.

* * * * *